US009629463B1

(12) United States Patent
Brock

(10) Patent No.: US 9,629,463 B1
(45) Date of Patent: Apr. 25, 2017

(54) TWO SHELF COMPUTER ACCESSORY STAND

(71) Applicant: William Edge Brock, Houston, TX (US)

(72) Inventor: William Edge Brock, Houston, TX (US)

( * ) Notice: Subject to any disclaimer, the term of this patent is extended or adjusted under 35 U.S.C. 154(b) by 0 days.

(21) Appl. No.: 14/473,498

(22) Filed: Aug. 29, 2014

(51) Int. Cl.

| | |
|---|---|
| ***A47B 43/00*** | (2006.01) |
| ***A47B 47/00*** | (2006.01) |
| ***A47B 57/00*** | (2006.01) |
| ***A47F 5/00*** | (2006.01) |
| ***A47B 97/00*** | (2006.01) |
| ***A47B 21/04*** | (2006.01) |
| ***A47B 96/02*** | (2006.01) |
| ***A47B 47/02*** | (2006.01) |
| ***A47B 47/04*** | (2006.01) |
| ***A47B 37/00*** | (2006.01) |

(52) U.S. Cl.
CPC ..... *A47B 97/00* (2013.01); *A47B 21/04* (2013.01); *A47B 37/00* (2013.01); *A47B 47/0083* (2013.01); *A47B 47/022* (2013.01); *A47B 47/024* (2013.01); *A47B 47/045* (2013.01); *A47B 96/02* (2013.01); *A47F 5/0062* (2013.01); *A47B 2097/006* (2013.01)

(58) Field of Classification Search
CPC ..... A47B 21/0314; A47B 2021/0321; A47B 2021/0335; A47B 2021/0364; A47B 47/0083; A47B 47/021; A47B 47/024; A47B 47/027; A47B 47/045; A47B 97/00; A47B 21/04; A47B 96/02; A47B 2097/006; A47B 21/00; A47B 21/02; A47B 96/027; A47B 47/008; A47B 7/00; A47B 13/00; A47B 17/00; A47B 23/04; A47B 37/00; A47B 2023/049; A47B 2031/004; A47B 47/022; A47B 57/045; A47F 5/0018; A47F 5/0043; A47F 7/145; A47F 5/0062; A47F 5/16; A47F 5/00
USPC ... 211/134, 186, 189, 133.1, 128.1, 188, 52, 211/55, 193; 108/92, 93, 96, 106, 108, 108/101, 60.01, 50.02, 180, 186; 312/196, 223.3
See application file for complete search history.

(56) References Cited

U.S. PATENT DOCUMENTS

| | | | | | |
|---|---|---|---|---|---|
| 4,546,708 | A | * | 10/1985 | Wilburth | 108/94 |
| 4,579,311 | A | * | 4/1986 | Spranza, III | 248/553 |
| 4,632,349 | A | * | 12/1986 | Anstey | 248/281.11 |
| 4,940,149 | A | * | 7/1990 | Vineis | 211/186 |
| 5,357,873 | A | * | 10/1994 | Hilton | 108/50.01 |
| 5,623,881 | A | * | 4/1997 | Huang | 108/50.01 |
| 5,746,139 | A | * | 5/1998 | Villanueva | 108/92 |
| 5,845,586 | A | * | 12/1998 | Moore | 108/50.01 |
| 6,206,495 | B1 | * | 3/2001 | Peterson | 312/283 |
| 6,439,133 | B1 | * | 8/2002 | Jaramillo | 108/25 |
| 7,770,743 | B1 | * | 8/2010 | Janowak et al. | 211/119.12 |
| 2002/0113530 | A1 | * | 8/2002 | Hatch et al. | 312/223.3 |
| 2003/0075083 | A1 | * | 4/2003 | Devey | 108/92 |

(Continued)

*Primary Examiner* — Jennifer E Novosad

(57) ABSTRACT

A desktop work stand having a rectangular base, a lower rectangular shelf and an upper rectangular shelf both supported from the base by vertical cylindrical columns, with the rectangular base being adapted to sit on an existing desk, table, or counter top to enable the user to place existing computer accessories on the shelves and base and to operate such computer accessories while the user is standing upright.

8 Claims, 1 Drawing Sheet

© 2016 William E. Brock

(56) References Cited

U.S. PATENT DOCUMENTS

| | | | | |
|---|---|---|---|---|
| 2004/0216645 | A1* | 11/2004 | Lin | 108/50.01 |
| 2005/0274300 | A1* | 12/2005 | Chen | 108/115 |
| 2007/0169673 | A1* | 7/2007 | Tseng | 108/65 |
| 2008/0203865 | A1* | 8/2008 | Chouinard et al. | 312/223.3 |
| 2008/0302748 | A1* | 12/2008 | Tsai | 211/188 |
| 2012/0055380 | A1* | 3/2012 | Chung et al. | 108/127 |
| 2012/0285912 | A1* | 11/2012 | Koessl | 211/70.6 |
| 2013/0126682 | A1* | 5/2013 | Tholkes et al. | 248/125.8 |
| 2013/0139736 | A1* | 6/2013 | Flaherty | 108/106 |
| 2014/0144352 | A1* | 5/2014 | Roberts | 108/96 |

* cited by examiner

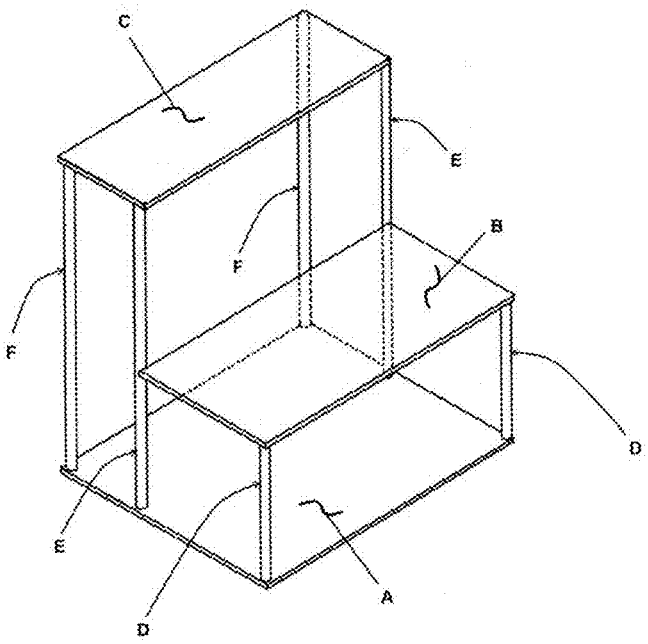
© 2016 William E. Brock

TWO SHELF COMPUTER ACCESSORY STAND

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO A SEQUENCE LISTING, A TABLE, OR A COMPUTER PROGRAM LISTING COMPACT DISC APPENDIX

Not Applicable

BACKGROUND OF THE INVENTION

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

Field of the Invention

The Technical Field of this application is that of ergonomic workplace furniture and equipment, specifically related to an adjustable, but very stable multiple-shelf stand to support computer accessories for use by workers while they are standing.

I am the inventor of this two shelf computer accessory stand. I have a college degree as an engineer, and I have worked in the office on computers since 1985.

Over the last 29 years, I began to slowly but steadily gain weight, to a large part due to sitting in my chair many hours at work each day while working on the computer.

Working in offices at various companies over the years I have also had problems with occasional neck, back, arm, and wrist pain and discomfort, due to the desks, computer monitors, and keyboards not being ergonomically best positioned to reduce such strain.

To seek to reduce user discomfort and to burn more calories, I decided to get out of my chair and try standing up while working on my computer, so that I could occasionally flex my back muscles, move my legs, flex my back, and shift my weight between my feet while also working on my computer keyboard, mouse, and monitor.

So I went to large local retail stores which sell computer equipment and asked their representatives to sell me a computer stand I could set on my desk to use the computer while standing upright. None of the stores I checked offered any such product for sale, and the sales representatives seemed surprised at my request.

Then, not being able to purchase such a computer accessory stand, I made a crude prototype to test my theory that standing up is better for me, the computer user, than sitting down. I took some empty cardboard boxes and taped them together to arrange a temporary platform with the right dimensions, to place on my work desk at the right height for my needs. Then I placed my laptop computer on top of this cardboard box platform and while standing I began using my laptop computer, placed on top of the cardboard box platform.

I found that I was satisfied with the keyboard height and preferred to work while standing up, using the laptop on top of this early prototype cardboard platform. However, while using the laptop my neck was constantly titled downward at an uncomfortable angle, leading to some neck strain.

So, I decided to build a wooden prototype two shelf computer accessory stand following the design shown in FIG. 1 and began to use it in 2012. The top platform supports the computer monitor directly in front of my face in the right position, so that I can work on the computer and view the monitor while maintaining good erect posture, looking straight forward without tilting my neck up or down at an uncomfortable angle. I have used this two shelf computer accessory stand prototype ever since, and prefer to perform computer work while standing. This standing posture makes me feel more alert and less sluggish while working on the computer multiple hours per day. I also have less aches and pains while still spending a lot of time working on my computer.

Background Art

Currently, there are specialized computer desks designed for use while standing, treadmills modified to use computers while exercising, and complex adjustable computer accessory stands with supports stabilized by springs and counter weights.

However, there are no two shelf computer accessory stands with a broad base, simply designed to be set upon an existing office desk or table, with firm, stable vertical cylindrical supports providing comfort and stability for the worker's use while he or she is standing. Simple vertical cylindrical supports provide more stability, much less vibration and erratic motion, and more comfortable and more productive platforms for the worker's use than do complex supports consisting of cantilevers, springs, and counterweights. This simple system is also less expensive to manufacture and sell, making it more likely to be purchased by companies and individual consumers, with the potential of changing the paradigm of office work from the sedentary, unhealthy seated norm to a new more healthy standing alternative.

BRIEF SUMMARY OF THE INVENTION

This product is a two shelf support system for the computer monitor, keyboard and mouse, allowing the computer user to work with the computer while standing up at his/her desk at office or at home. It is designed as one integrated structure which simply sits on top of one's existing desk, table, or counter top.

BRIEF DESCRIPTION OF THE SEVERAL VIEWS OF THE DRAWING

The FIGURE: Isometric View of the Two Shelf Computer Accessory Stand

DETAILED DESCRIPTION OF THE INVENTION

This two shelf computer accessory stand is designed for the user to simply place on top of an existing desk at home or at the office, then move his/her monitor and keyboard, with separate mouse, if applicable, over to this stand and use the computer while the user is standing upright. The shelves are specifically constructed at the best heights above the desk a) to position the computer monitor at the correct eye level so the user looks straight ahead, maintaining good straight posture without straining/craning his/her neck, and also b) to position the computer keyboard, with or without a separate mouse, at the correct height so that the user's forearms and wrists lie flat during computer usage, so that the positions of the computer monitor, keyboard, and mouse minimize strain on the user.

Then, if/when the user no longer wishes to stand upright to work on the computer, he or she can simply manually lower the monitor and keyboard either a) to their desk top or b) to the lower shelf and base of the computer stand, respectively, to work while sitting down for a period of time. Another option, to work while sitting for periods of time, is for the user to have duplicate monitors installed, one installed on the desk adjacent to the two shelf computer accessory stand, simply relocate the keyboard and mouse to the desk top, and switch the computer output to the desk top monitor.

Basic design of this two shelf computer accessory stand is shown in the attached drawing of the basic stand model, The FIGURE. The stand is composed of a flat, rectangular base, with vertical cylindrical upright supports which support a lower shelf at the front side of the stand, and a higher shelf at the back side of the stand. See the attached drawing, The FIGURE.

Materials of the shelves and vertical upright cylindrical supports may be either ferrous, or non-ferrous materials, including without limitation plain carbon steel, stainless steel, wood, bamboo, aluminum, plastic, fiberglass, laminates, and all other materials that may be chosen to support safely the weight of the computer accessories, from four ounces to 70 pounds.

Height of the two shelves above the base may be fixed for different models to be manufactured and sold, or may be variable, to be adjusted by the product purchaser using threaded upright cylindrical supports.

The components of this invention shown in FIG. 1 are the rectangular base A, a middle shelf B, and an upper shelf C. The middle shelf is supported by the front pair of vertical cylindrical columns D and the intermediate pair of vertical cylindrical columns E, while the top shelf is supported by the intermediate pair of vertical cylindrical columns E and the back pair vertical cylindrical columns F.

A variety of models of this basic design may be manufactured and sold to meet the requirements of various computers and computer accessories, as well as for different ergonomic needs of users of various heights, arm lengths, and personal dimensions. Some models shall be manually adjustable, with threaded vertical cylindrical supports for each user to vary the height of the shelves as needed.

What is claimed is:

1. A desktop work stand for support of existing computer accessories, including a computer keyboard, a mouse, and a monitor, in a manner enabling a computer user to stand while operating the computer accessories, the desktop work stand consisting essentially of:

(a) a flat rectangular base having a lower surface, a top surface opposite the lower surface, two front corners, two rear corners, and a perimeter, whereby the top surface has space for work or storage of office items, and the lower surface adapted to be placed directly on an existing desk or table top that is adapted to be located above a ground surface on which the desk or table top is supported;

(b) three pairs of vertical cylindrical columns, each of said columns having a lower end attached directly to the top surface of the base, and each of the columns having an upper end opposite the lower end and defining a length therebetween, with a first one of the pairs of vertical columns positioned and fixed at the two front corners of the base, a second one of the pairs of the vertical columns positioned and fixed at the two rear corners of the base, and a third one of the pairs of said vertical columns positioned and fixed on the perimeter of the base, on opposite right and left sides thereof, between the vertical columns positioned at the front and rear corners of the base;

(c) a flat rectangular lower platform having a lower surface, an upper surface, a front edge and a rear edge, whereby a first width is defined between the front and rear edges of the lower platform, and the lower platform being positioned above and parallel to the base, and supported from the top surface of the base by the first one of the pairs of the vertical cylindrical columns fixed to the lower surface of the lower platform at the front edge thereof, and the third one of the pairs of vertical columns fixed to the lower platform near the rear edge thereof, whereby the lower platform is located between the upper and lower ends of the third one of the pairs of vertical columns, wherein the upper surface of said lower platform is sized for supporting the computer keyboard and mouse; and (d) a flat rectangular top platform having a lower surface, an upper surface, a front edge and a rear edge, whereby a second width is defined between the front and rear edges of the top platform, and the top platform being positioned above and parallel to the base, and horizontally offset from the lower platform such that the rear edge of the lower platform lies in a first vertical plane and the front edge of the top platform lies in a second vertical plane whereby the first and second vertical planes are substantially adjacent one another, and the top platform being supported from the base by the upper ends of the third one of the pairs of the vertical columns being fixed to the lower surface at the front edge thereof, and by the upper ends of the second one of the pairs of the vertical columns fixed to the lower surface thereof at the rear edge, wherein said top platform is sized for supporting the computer monitor.

2. The desktop work stand according claim 1, wherein the first width of the lower platform is greater than the second width of the top platform.

3. The desktop work stand according claim 2, wherein the first width is between 8 and 24 inches.

4. The desktop work stand according claim 2, wherein the second width is between 6 and 18 inches.

5. The desktop work stand according claim 1, wherein the length of the first one of the pairs of vertical columns is between 8 and 20 inches.

6. The desktop work stand according claim 1, wherein the length of the second one of the pairs and the third one of the pairs of vertical columns is equal.

7. The desktop work stand according claim 6, wherein the length of the second and third ones of the pairs of vertical columns is between 16 and 34 inches.

8. The desktop work stand according claim 1, wherein the vertical columns, the base, the lower platform and the top platform, can be made from materials defining carbon steel, stainless steel, wood, bamboo, aluminum, plastic, fiberglass or laminate.

* * * * *